US006939278B2

(12) United States Patent
Atwell

(10) Patent No.: US 6,939,278 B2
(45) Date of Patent: Sep. 6, 2005

(54) COMBINED EXERCISER AND THERAPIST TABLE

(76) Inventor: Carol A. Atwell, 84 Old Port Rd., Kennebunk, ME (US) 04043

( * ) Notice: Subject to any disclaimer, the term of this patent is extended or adjusted under 35 U.S.C. 154(b) by 0 days.

(21) Appl. No.: 10/702,752

(22) Filed: Nov. 6, 2003

(65) Prior Publication Data

US 2005/0101462 A1 May 12, 2005

(51) Int. Cl.[7] ..... A63B 26/00

(52) U.S. Cl. ..... 482/142; 482/121; 482/122; 482/123; 482/124; 482/125; 482/128

(58) Field of Search ..... 482/148, 142, 482/121, 122, 123, 124, 125, 128; 602/32; 108/17

(56) References Cited

U.S. PATENT DOCUMENTS

| | | | | |
|---|---|---|---|---|
| 5,518,485 | A | 5/1996 | Zislis | |
| 5,769,766 | A | 6/1998 | Huang | |
| 5,772,612 | A | 6/1998 | Ilan | |
| 5,989,168 | A | 11/1999 | See | |
| 5,997,450 | A | 12/1999 | Wilkenson | |
| 6,206,809 | B1 | 3/2001 | Habing | |
| 2003/0078145 | A1 * | 4/2003 | Winkler | 482/142 |
| 2004/0176227 | A1 * | 9/2004 | Endelman | 482/142 |
| 2004/0198572 | A1 * | 10/2004 | Rouillard | 482/142 |
| 2005/0003937 | A1 * | 1/2005 | Chen | 482/104 |
| 2005/0032614 | A1 * | 2/2005 | Keiser et al. | 482/142 |

* cited by examiner

*Primary Examiner*—Stephen R. Crow
*Assistant Examiner*—L. Amerson
(74) *Attorney, Agent, or Firm*—William F. Hamrock, PA

(57) ABSTRACT

A combined exerciser and therapist table (1) having an exercise pad (2) on rollers (4) on roller tracks (5) supported by an exerciser frame (6) on legs (7) that include height adjustment. The exerciser frame is rectangular with a head end (8) and a foot end (9). The exercise pad includes a torso portion (10) proximate the head end and a leg portion (11) proximate the foot end of the exerciser frame. A vertically oriented foot-end frame (14) is attached detachably to tops of the legs at the foot end. The foot-leg frame includes a 1 plurality of strap hooks (15, 26) that are oppositely disposed for supporting a leg strap (16, 30) at desired spaced-apart distances above the foot end. A horizontal pressure bar (17) pivots downwardly to a desired position above the exercise pad and is pivotal vertically to a non-interference position parallel the upstanding foot frame.

13 Claims, 10 Drawing Sheets

14
26
38
33
32
7
37
35
34
39
24
36
9
11
44
43
6
10
4
8
2
3
19
28
29

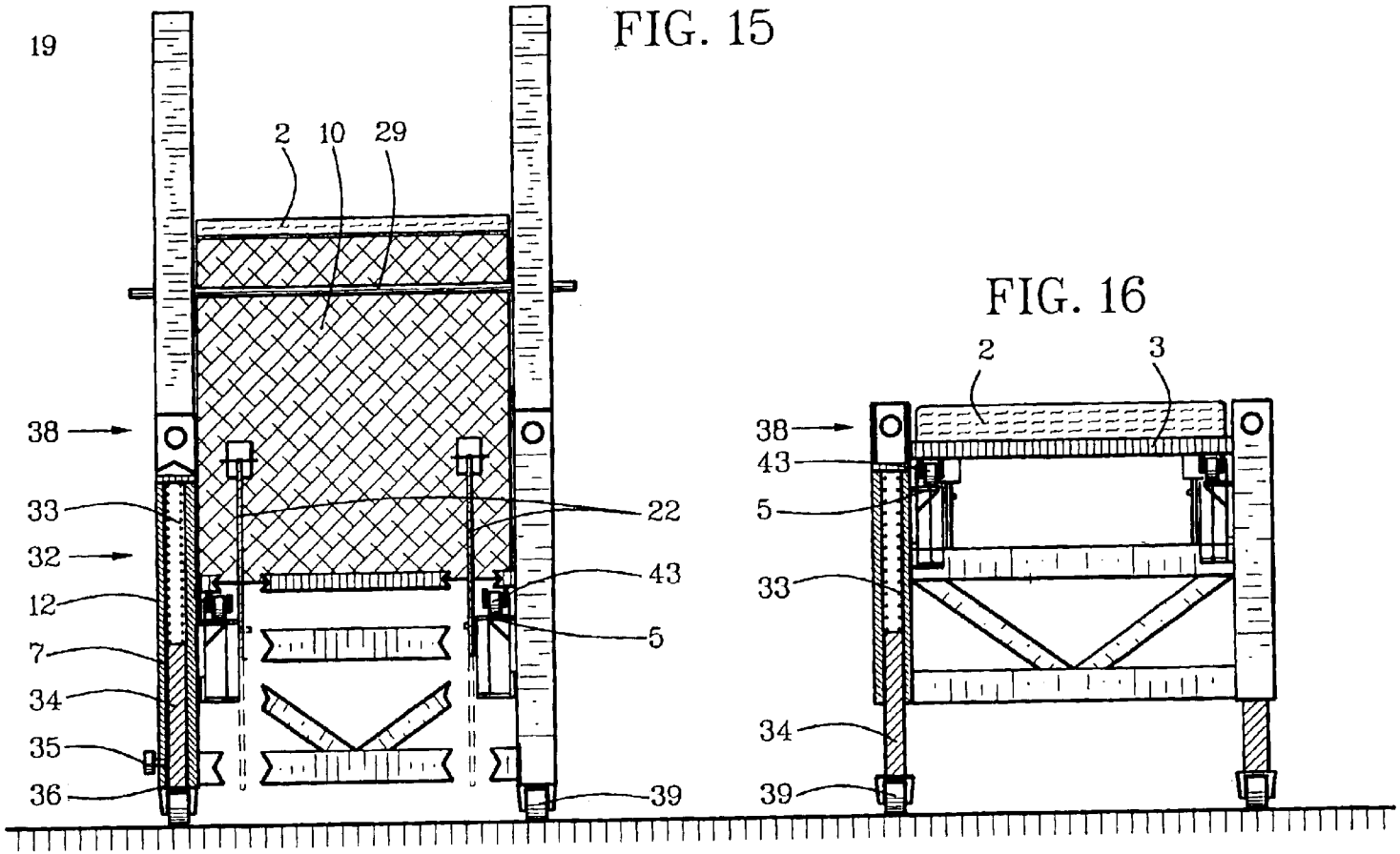
FIG. 15
FIG. 16
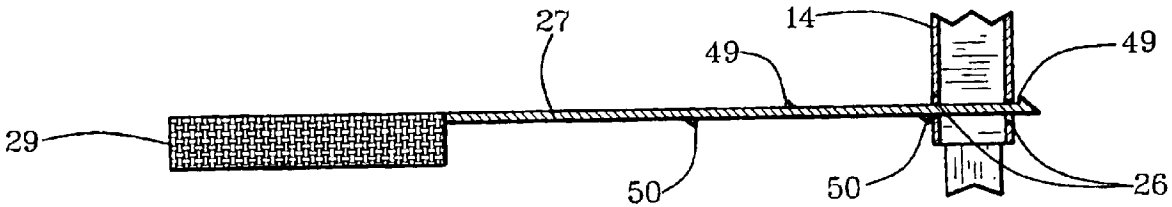
FIG. 17

COMBINED EXERCISER AND THERAPIST TABLE

BACKGROUND OF THE INVENTION

1. Field of the Invention

This invention relates to exercising by stretching, decompressing traction and by pushing, compressing contraction of spinal and other bodily joints, muscles, tendons and soft tissues selectively with a combined exerciser and therapist table.

2. Relation to Prior Art

There are numerous known exercise machines for weight-bearing, pressure-bearing and pushing contraction of joints and muscles, but none which provide stretching, decompressing traction in addition to pushing, compressing contraction of spinal and other bodily joints, muscles, tendons and soft tissues selectively with a combined exerciser and therapist table in a manner taught by this invention.

Listed below for consideration is known related prior art:

| Number | Inventor | Issue/Disclosure Date |
|---|---|---|
| U.S. Pat. No. 6,338,704 B1 | Endelman | Jan. 15, 2002 |
| U.S. Pat. No. 6,206,809 B1 | Habing, et al. | Mar. 27, 2001 |
| U.S. Pat. No. 5,997,450 | Wilkinson | Dec. 7, 1999 |
| U.S. Pat. No. 5,989,168 | See | Nov. 23, 1999 |
| U.S. Pat. No. 5,772,612 | Ilan | Jun. 30, 1998 |
| U.S. Pat. No. 5,769,766 | Huang | Jun. 23, 1998 |
| U.S. Pat. No. 5,518,485 | Zislis | May 21, 1996 |

SUMMARY OF THE INVENTION

Objects of patentable novelty and utility taught by this combined exerciser and therapist table are to:

relieve compression of spinal and other bodily joints, muscles, tendons and soft tissues with stretching, decompressing traction;

provide weight-bearing compression of the spinal and other bodily joints, muscles, tendons and soft tissues with compressing contraction;

provide selectively alternating decompressing traction and compressing contraction of the spinal and other bodily joints, muscles, tendons and soft tissues;

position a user in selectively prone and sitting positions for exercising specific spinal and other bodily joints, muscles, tendons and soft tissues without undesired effects on other parts of the user's body;

position the user on a therapist table for access by a therapist;

provide a therapist table with therapist-controllable tractional and contractional exercise of the user; and to gage and time tractional and contractional power applied for exercising selectively.

This invention accomplishes these and other objectives with a combined exerciser and therapist table having an exercise pad on oppositely disposed rollers that are rotational on oppositely disposed roller tracks that are supported by an exerciser frame on legs that preferably include height adjustment. The exerciser frame is rectangular with a head end and a foot end.

The exercise pad includes a torso portion proximate the head end and a leg portion proximate the foot end of the exerciser frame. Preferably the torso portion is pivotal vertically between horizontality and select angular-support positions at which it is lockable with a support lock.

A vertically oriented head-end frame is attached detachably to tops of the legs at the head end. A vertically oriented foot-end frame is attached detachably to tops of the legs at the foot end. The head-end frame includes a plurality of bar hooks that are oppositely disposed for supporting a cross bar horizontally at desired spaced-apart distances above the head-end. The foot-end frame includes a plurality of strap hooks that are oppositely disposed for supporting a leg strap at desired spaced-apart distances above the foot end.

One or more resistance members articulated for resisting travel of the exercise pad is positioned intermediate the leg portion and the foot end of the exerciser frame predeterminedly.

A pressure bar has a first-end beam that is length-adjustable attached pivotally to a first side of the foot end and a second-end beam that is length-adjustable attached pivotally to a second side of the foot end. The pressure bar is pivotal to a desired position above the exercise pad for being hand-grasped by a user on the exercise pad for applying exercise pressure in opposition to the resistance member and the leg strap selectively for transmission of the exercise pressure to the user's torso and upper legs with the user's lower legs hooked over the leg strap.

Optionally, the pressure bar is pivoted vertically to a non-interference position and the user hand-grasps the cross bar for applying exercise pressure in opposition to the leg strap selectively for transmission of the exercise pressure to the user's torso and upper legs with the user's lower legs hooked over the leg strap.

An exercise-pressure gage can be positioned on the pressure bar and the leg strap for measuring exercise pressure applied. The exercise frame is height-adjustable on the legs for use as a therapist table with the head-end frame and the foot-end frame optionally removed. The legs preferably include wheels on at least a wheel end of the combined exerciser and therapist table.

This invention is unique in its design to strengthen the deepest muscles of the human trunk and abdomen while also lengthening the lumbar-pelvic regions. It provides a means of unloading/decompressing unwanted pressure/pain of the spinal column associated with everyday-life activities. A user is in complete control of an amount of traction created by an amount of force the user applies to a pressure bar.

With an exercise pad on rollers being precision-smoothed, the exercise pad glides smoothly and gently without any jolting or sudden interruption of movement. The exercise pad is equipped with selected resistance members to be used in targeting and strengthening various muscles of the trunk region.

Mechanically, the machine is articulated to be used also as a clinical therapy bed or table. The exercise pad is split for use in any position from lying to sitting straight up. Both end frames are easily lifted off of the machine and the pressure bar is equipped with a position-locking system for allowing non-interference use of the exercise pad. To automatically raise the pressure bar up and out of the user's way for use as a therapist table, the pressure bar has an optional counterweight or pivoter.

BRIEF DESCRIPTION OF DRAWINGS

This invention is described by appended claims in relation to description of a preferred embodiment with reference to the following drawings which are explained briefly as follows:

FIG. 15 is a partially cutaway head-end view of the FIG. 14 illustration;

FIG. 16 is a partially cutaway head-end view of the FIG. 12 illustration with the exercise pad raised and with the foot-end and head-end frames removed for the therapist-table mode; and FIG. 17 is a partially cutaway fragmentary view of a portion of the FIG. 14 illustration showing rigid-positioning attachment of the leg rods to the foot-end frame.

DESCRIPTION OF PREFERRED EMBODIMENT

Figure 1:
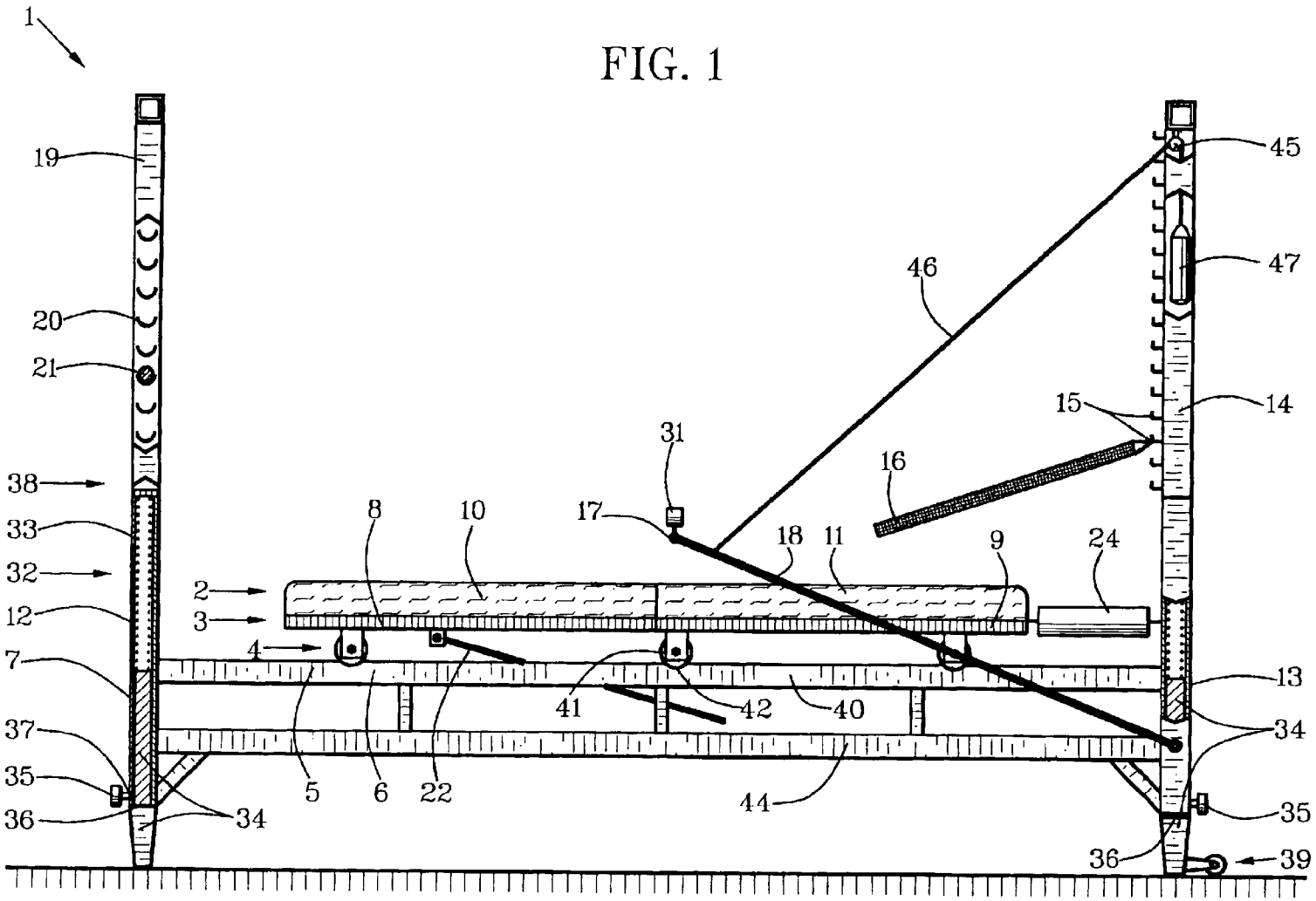
FIG. 1 is a partially cutaway side view of a decompression embodiment of the combined exerciser and therapist table with edge-rimmed rollers on roller tracks that are tubular beams.

Listed numerically below with reference to the drawings are terms used to describe features of this invention. These terms and numbers assigned to them designate the same features throughout this description.

1. Combined exerciser and therapist table
2. Exercise pad
3. Pad frame
4. Rollers
5. Roller tracks
6. Exerciser frame
7. Legs
8. Head end
9. Foot end
10. Torso portion
11. Leg portion
12. Head-leg frame
13. Foot-leg frame
14. Foot-end frame
15. Strap hooks
16. Leg strap
17. Pressure bar
18. Bar-end beams
19. Head-end frame
20. Bar hooks
21. Hand bar
22. Support bar
23. Bar lock
24. Resistance member
25. Two-way resistor
26. Leg-rod attachments
27. Leg rods
28. Lift-bar hooks
29. Lift bar
30. Leg bar
31. Pressure gage
32. Table-height adjuster
33. Lift springs
34. Leg bottoms
35. Adjustment bolts
36. Leg-bottom apertures
37. Leg apertures
38. Quick-disconnect attachment
39. Wheels
40. Tubular beams
41. Edge-rimmed rollers
42. Roller rim
43. Non-rimmed rollers
44. Support beam
45. Pulley
46. Pulley line
47. Pulley weight
48. Pivoter
49. Up ratchet
50. Down ratchet Referring to FIGS. 1–4, the combined exerciser and therapist table 1 has an exercise pad 2 on a pad frame 3 that is supported by oppositely disposed rollers 4 that are rotational on roller tracks 5 which are supported by an exerciser frame 6 on legs 7. The pad frame 3 is rectangular with a head end 8 and a foot end 9. The exercise pad 2 includes a torso portion 10 proximate the head end 8 and a leg portion 11 proximate the foot end 9 of the pad frame 3.

The exerciser frame 6 is rectangular with a head-leg frame 12 proximate a head end and a foot-leg frame 13 proximate a foot end of the exerciser frame 6.

A vertically oriented foot-end frame 14 is attached detachably to tops of the legs 7 of the foot-leg frame 13. The foot-end frame 14 includes a plurality of strap hooks 15 that are oppositely disposed for supporting a leg strap 16 at desired vertically spaced-apart distances above the foot-leg frame 13.

A pressure bar 17 has oppositely disposed bar-end beams 18 attached pivotally to oppositely disposed sides of the foot-leg frame 13 respectively.

Referring to FIGS. 5–16, the pressure bar 17 is pivotal to a desired position above the exercise pad 2 for being hand-grasped by a user on the exercise pad 2 for applying exercise pressure in opposition to the leg strap 16 selectively for transmission of the exercise pressure to the user's torso and upper legs with the user's lower legs hooked over the leg strap 16.

A vertically oriented head-end frame 19 is attached detachably to tops of the legs 7 of the head-leg frame 12. The head-end frame 19 can include a plurality of bar hooks 20 that are oppositely disposed for supporting a hand bar 21 horizontally at desired vertically spaced-apart distances above the head-end 8.

Figure 2:
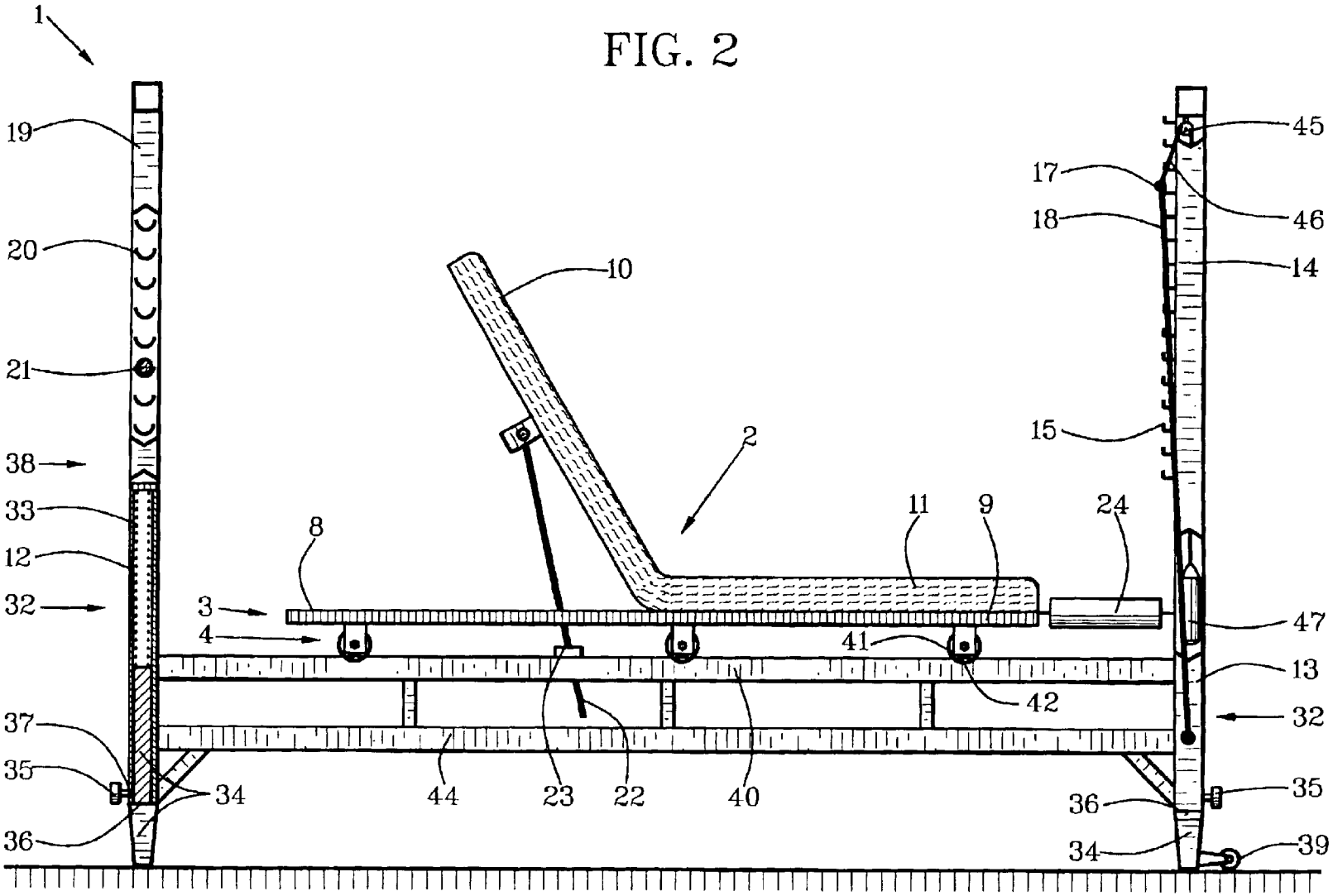
FIG. 2 is a partially cutaway side view of the FIG. 1 illustration with a torso portion of an exercise pad in an inclined orientation for sitting exercises.
Figure 4:
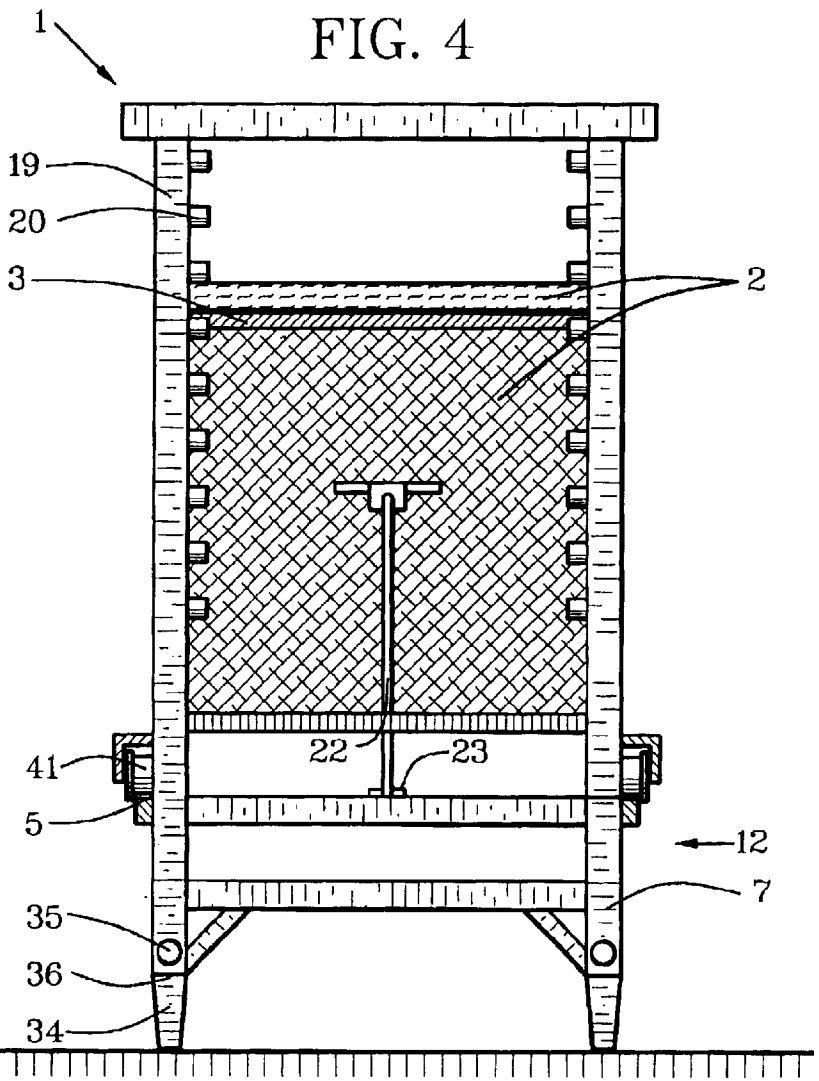
FIG. 4 is a partially cutaway head-end view of the FIG. 2 illustration.
Figure 3:
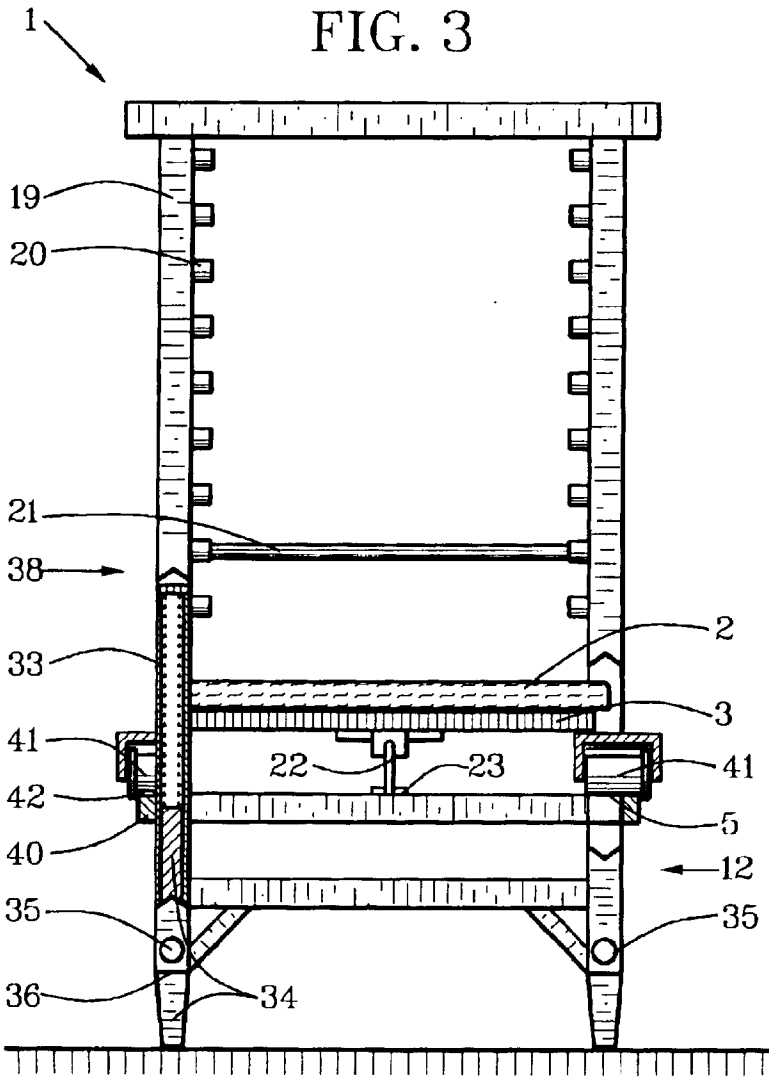
FIG. 3 is a partially cutaway head-end view of the FIG. 1 illustration with the exercise pad lowered to an exercise-use mode.
Figure 11:
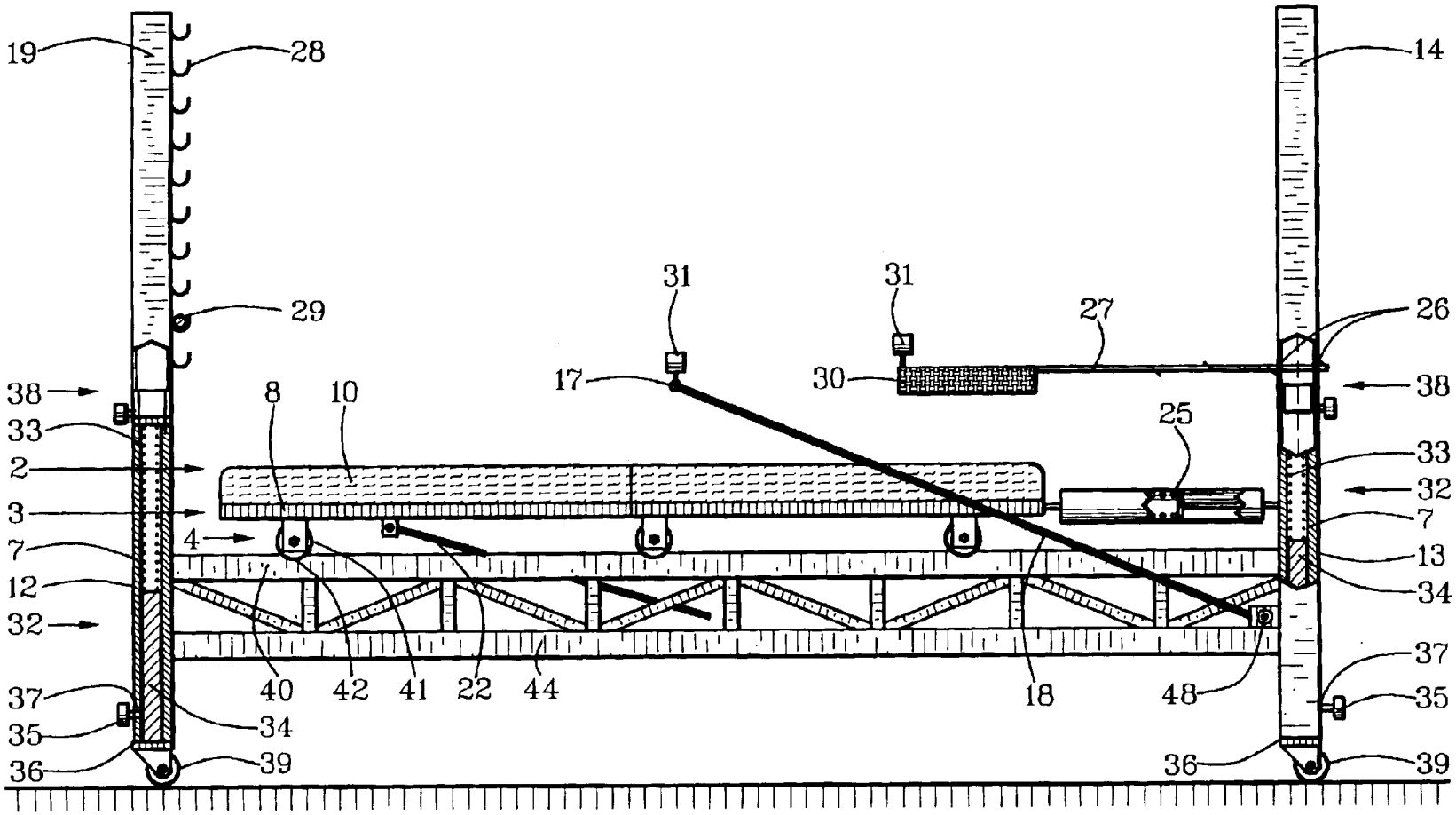
FIG. 11 is a partially cutaway side view of a heavy-duty compression-decompression, multiple-exercise embodiment of the combined exerciser and therapist table with rimmed rollers on roller tracks that are surfaces of rectangular beams and with rigid leg rods for a two-way leg bar.
Figure 14:
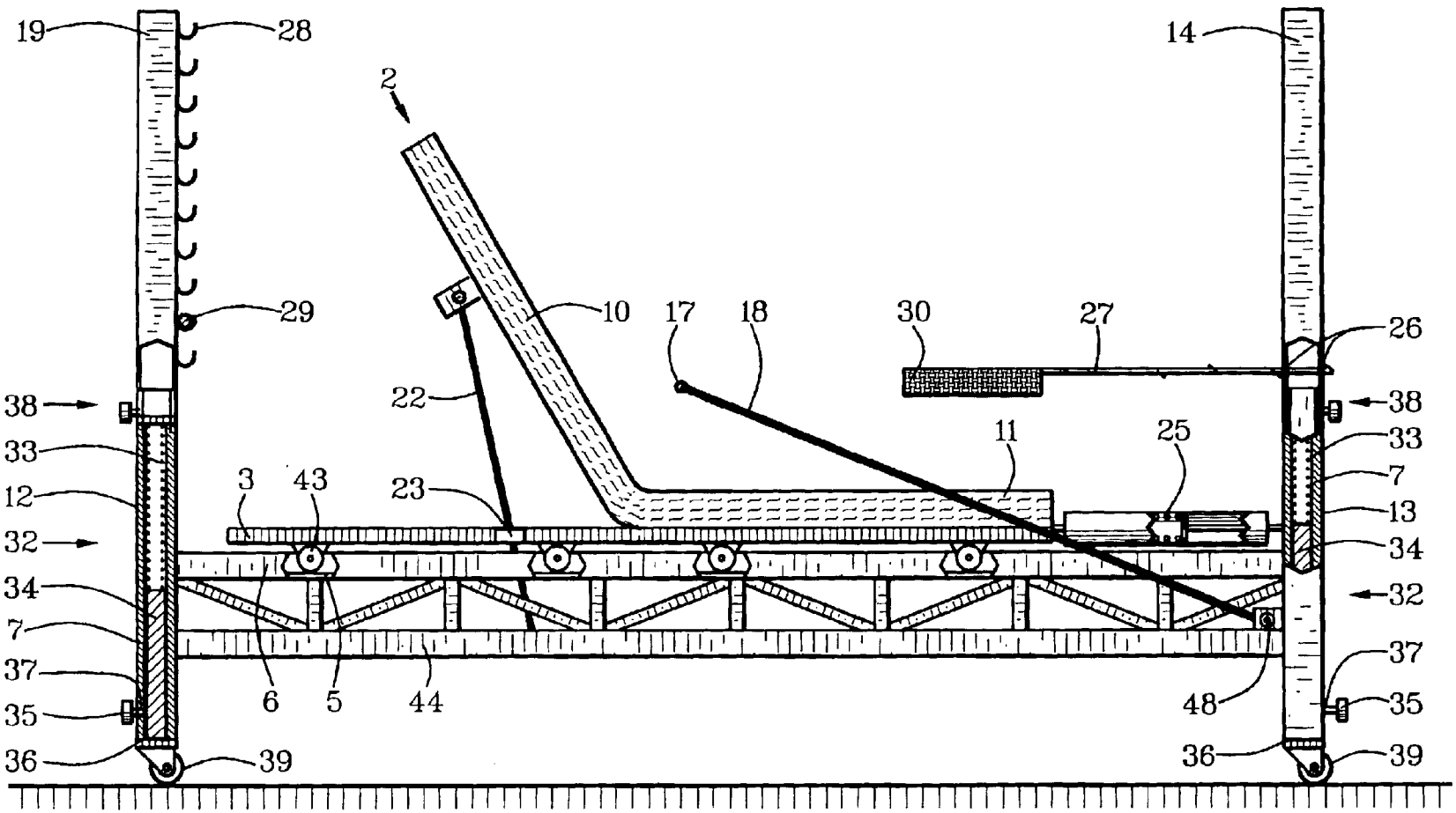
FIG. 14 is a partially cutaway side view of the FIG. 11 illustration with the torso portion of the exercise pad in an inclined orientation for sitting exercises.

As shown in FIG. 2, the pressure bar 17 is pivotal vertically to a non-interference position in which the bar-end beams 18 are selectively proximate parallel to the vertically oriented foot-end frame 14 for the user to hand-grasp the hand bar 21 for applying exercise pressure in opposition to the leg strap 16 selectively for transmission of the exercise pressure to the user's torso and upper legs with the user's lower legs hooked over the leg strap 16. Vertical pivoting of the pressure bar 17 to a non-interference position for freeing hands of the user can be provided with a pulley 45, pulley line 46 and pulley weight 47 as shown in FIGS. 1–2, or optionally with a pivoter 48 as shown in FIGS. 11 and 14.

The torso portion 10 is pivotal vertically between horizontality and select angular sitting-support positions at which the torso portion 10 is lockable with a support bar 22 extended selectively intermediate a bottom surface of the torso portion 10 and a bar lock 23 attached to the exerciser frame 6.

Figure 12:
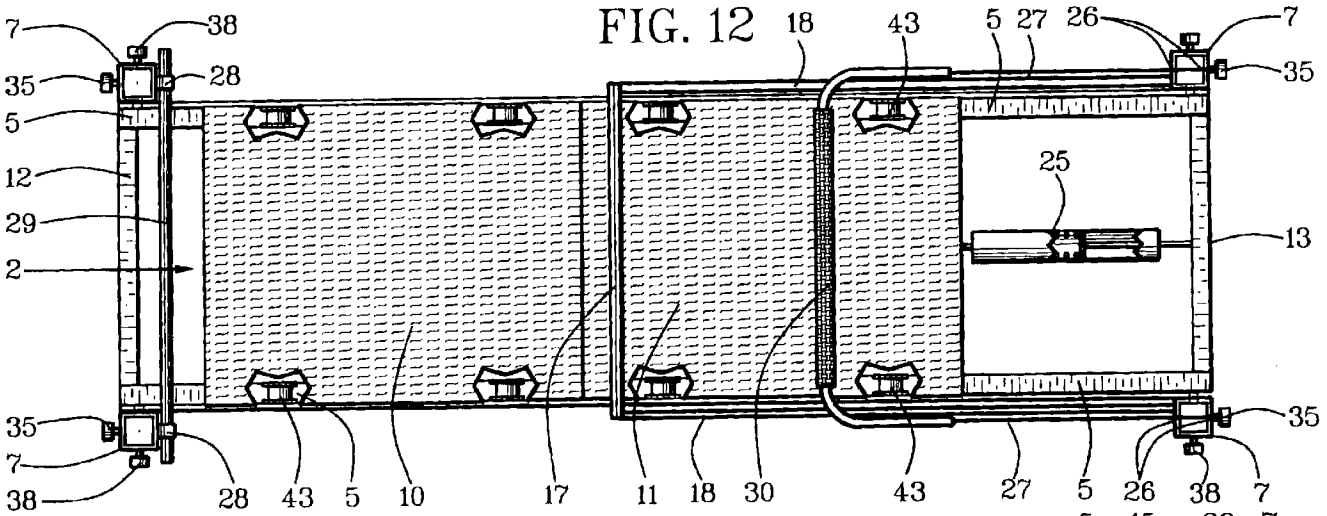
FIG. 12 is a partially cutaway top view of the FIG. 11 illustration.
Figure 13:
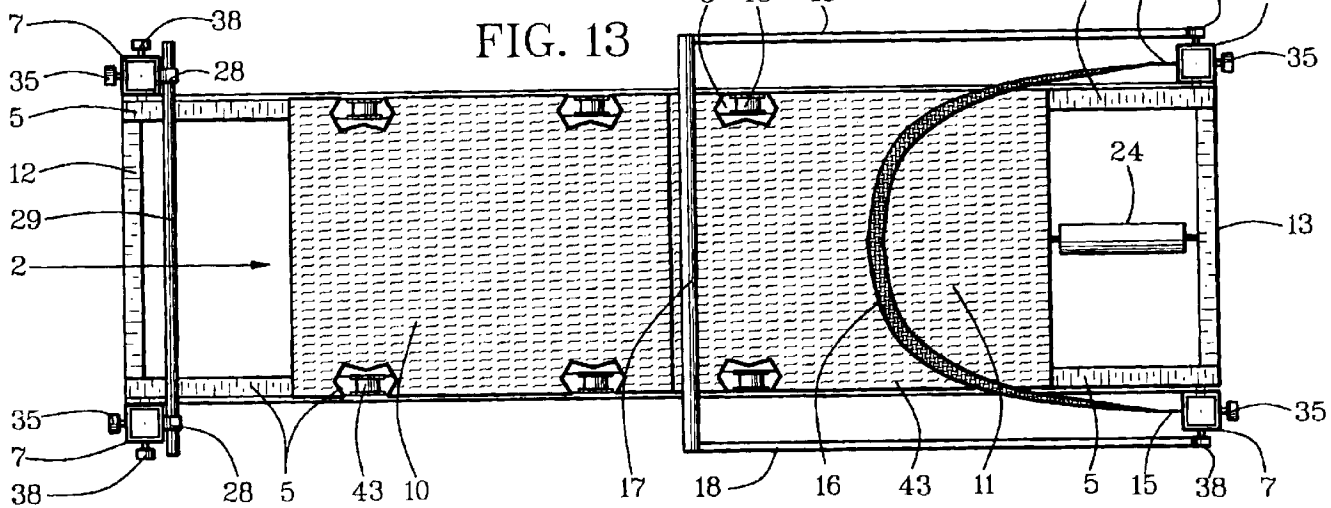
FIG. 13 is a partially cutaway top view of the FIG. 9 illustration.

One or more resistance members 24 is articulated for resisting travel of the exercise pad 2 intermediate the leg portion 11 and the foot-leg frame 13 of the exerciser frame 6 predeterminedly. As shown in FIGS. 11–12 and 14, the resistance member 24 can include a two-way resistor 25 having predetermined resilient pressure resistance to linear travel of the exercise frame 6 in either direction on the roller tracks 5. The roller tracks 5 preferably include surfaces of polygonal tubular, channel or angular beams that are appropriately heat-treated and smooth-surfaced.

The foot-end frame 14 can include a plurality of leg-rod attachments 26 that are oppositely disposed and articulated for supporting oppositely disposed leg rods 27 rigidly with predetermined horizontality at desired vertically spaced-apart distances above the foot-leg frame 13. As shown with enlarged detail in FIG. 17, a preferred leg-rod attachment 26 includes slots that receive an up ratchet 49 and a down ratchet 50 on the leg rods 27 with weight of the leg bar 30 maintaining the leg rods 27 predeterminedly horizontal and requiring up-slant orientation of the leg rods 27 for insertion, removal and length adjustment.

The head-end frame 19 can include a plurality of lift-bar hooks 28 that are oppositely disposed for supporting a lift bar 29 horizontally at desired vertically spaced-apart distances above the head end 8 as shown in FIGS. 5, 7, 11 and 14.

As shown in FIGS. 11–12, and 14, a leg bar 30 that is predeterminedly cushioned can be positioned intermediate the leg rods 27. For this feature, the pressure bar 17 is pivotal to a desired position above the exercise pad 2 for being hand-grasped by a user on the exercise pad 2 for applying exercise pressure in opposition to the leg bar 30 selectively in either direction for transmission of the exercise pressure to the user's torso and upper legs with the user's lower legs hooked over the leg bar 30.

The lift-bar hooks 28 can include weight-lifting features for retaining the lift bar 29 containing predetermined weights for weight-lifting exercise. The weight-lifting features allow vertical lifting of the lift bar 29 up and out of the lift-bar hooks 28 and also allow downward lowering of the lift bar 29 into the lift-bar hooks 28 by a user lying on the exercise pad 2. The lift-bar hooks 28 can include lateral-tension structure for withstanding tension from human-strength pushing and pulling laterally from the exercise pad 2.

Figure 5:
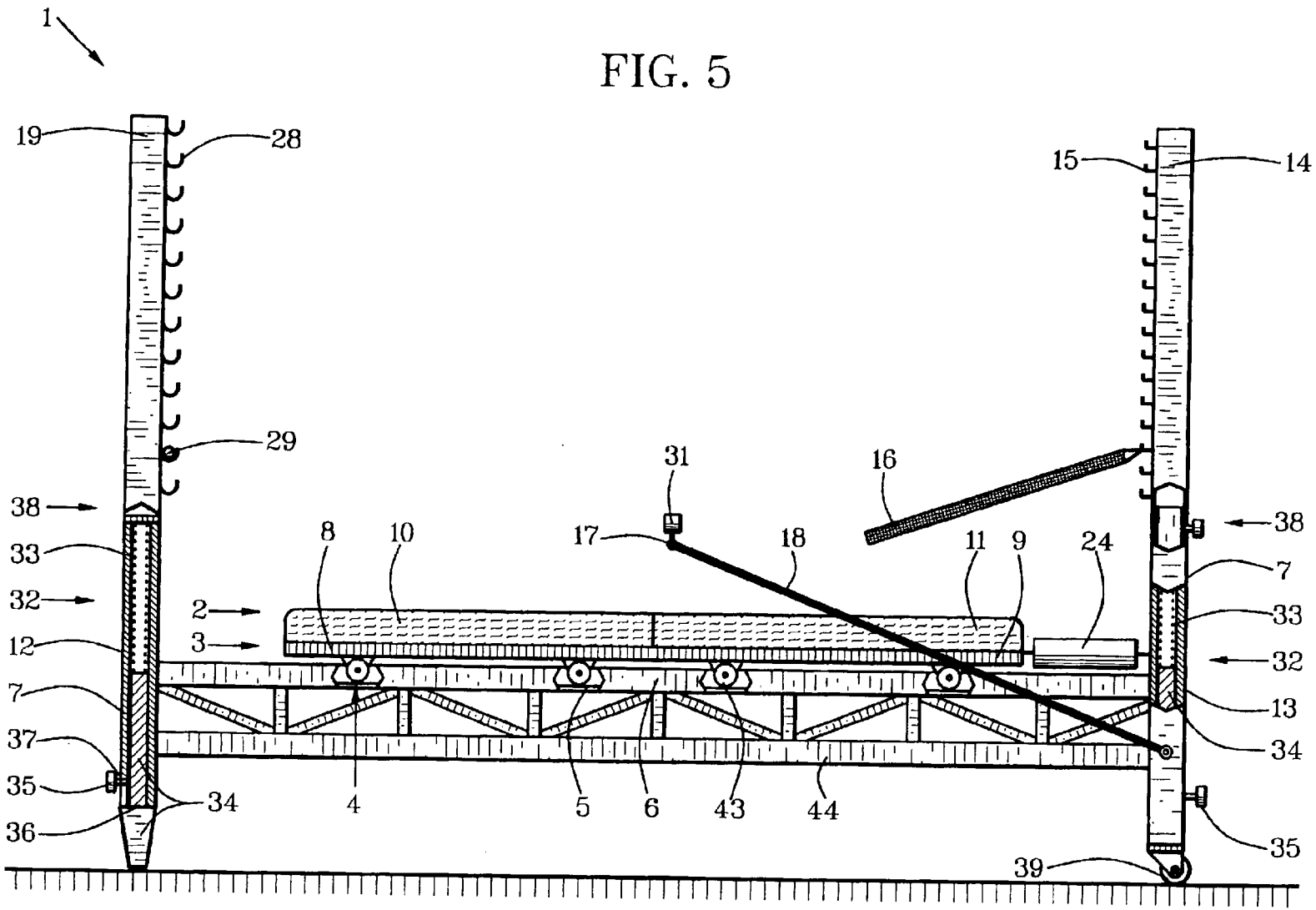
FIG. 5 is a partially cutaway side view of a heavy-duty embodiment of the combined exerciser and therapist table with non-rimmed rollers on roller tracks that are surfaces of angle beams.
Figures 6, 7, 8:
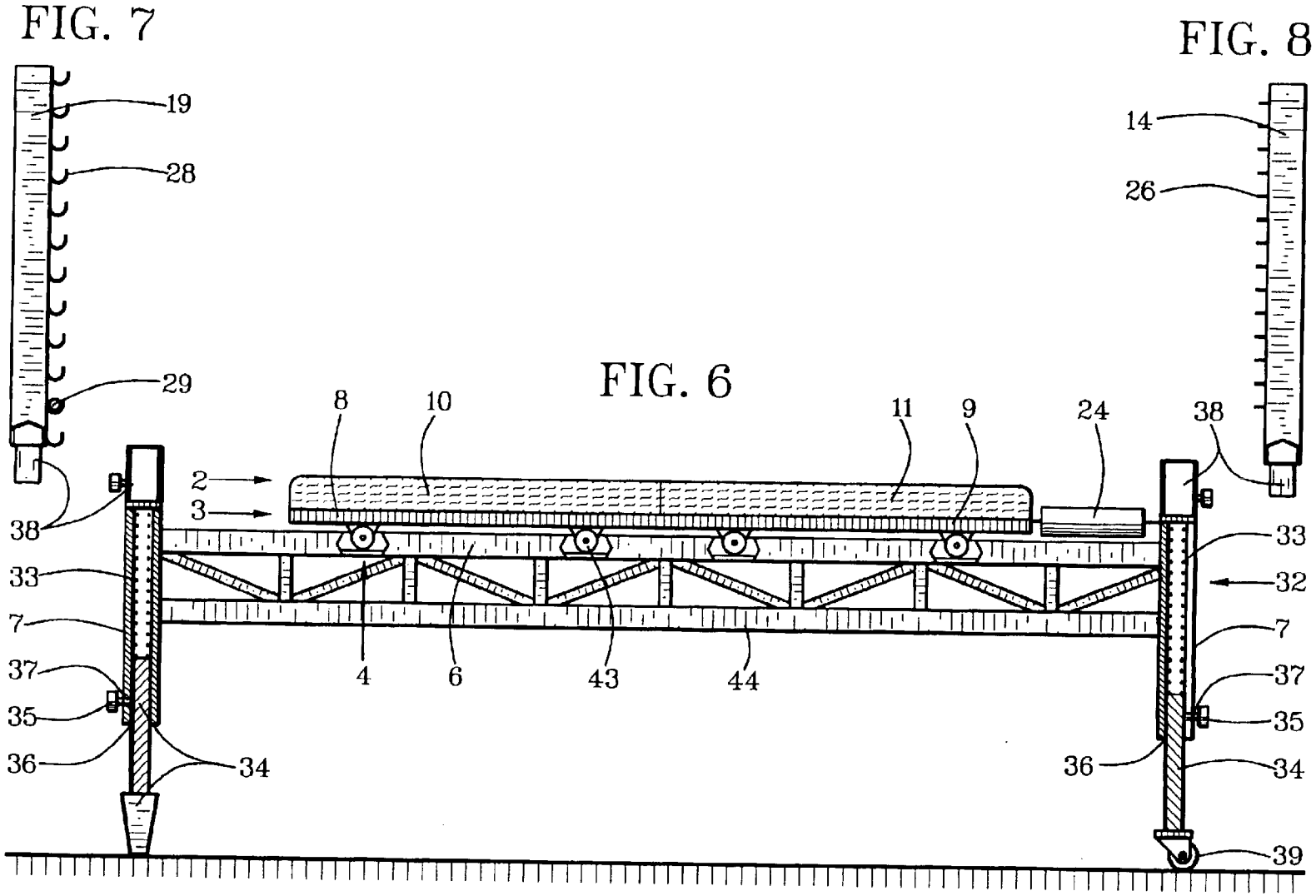
FIG. 6 is a partially cutaway side view of the FIG. 5 illustration with the exercise pad raised for therapist use and with a head-end frame and a foot-end frame removed for a therapist-table mode.
FIG. 7 is a partially cutaway side view of the head-end frame that has been removed for the therapist-table mode.
FIG. 8 is a partially cutaway side view of the foot-end frame that has been removed for the therapist-table mode.
Figure 10:
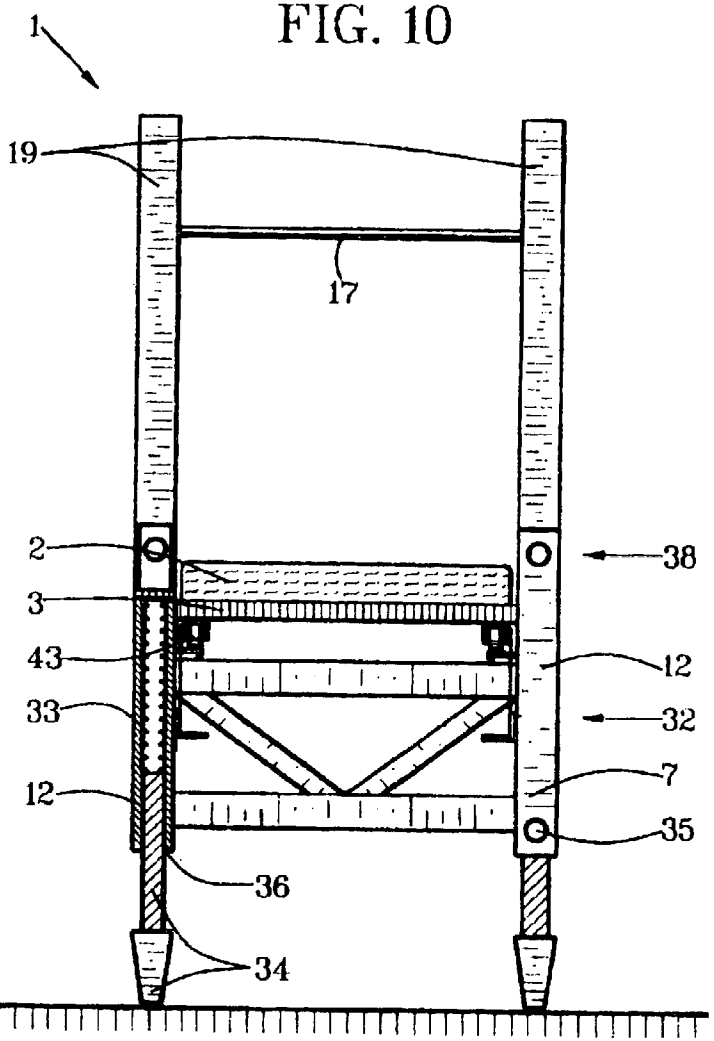
FIG. 10 is a partially cutaway head-end view of the FIG. 9 illustration with the exercise pad raised for therapist-table mode.
Figure 9:
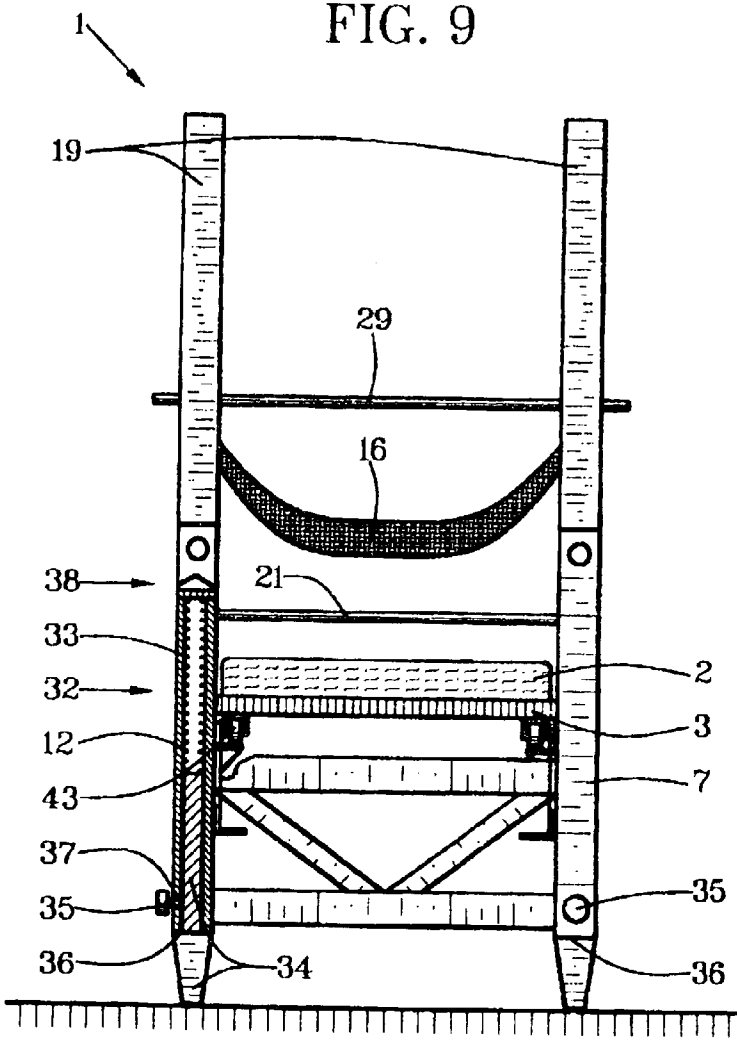
FIG. 9 is a partially cutaway head-end view of the FIG. 5 illustration with the exercise pad lowered for exercise mode.

As shown in FIGS. 1, 5, and 11, at least one pressure gage 31 can be positioned predeterminedly on the combined exerciser and therapist table 1 for measuring linear pressure applied by the exerciser in opposition to the foot-leg frame 13. Positioning of the pressure gage 31 can include positioning on the pressure bar 17 for measuring pressure applied by the exerciser intermediate the pressure bar 17 and the leg bar 30. Positioning of the pressure gage 31 can include positioning on the leg bar 30 for measuring pressure applied by the exerciser intermediate the foot-leg frame 13 and the leg bar 30.

As shown in FIGS. 1–6, 9–11 and 14–16, the legs 7 can include table-height adjusters 32 for positioning the exercise pad 2 at desired heights for exerciser use and optionally for therapist use to treat the user on the exercise pad 2. The table-height adjusters 32 include lift springs 33 positioned in the legs 7 and pressured against leg bottoms 34 in each of the legs 7. The lift springs 33 can be anchored to the legs 7. The table-height adjusters 32 can have handled adjustment bolts 35 for being inserted through leg apertures 37 for fixing desired table heights by bolt-locked extension of the leg bottoms 34 through leg-bottom apertures 36.

As shown in FIGS. 5–11 and 14, the attachment of the head-end frame 19 and attachment of the foot-end frame 14 to the legs 7 can include predetermined quick-disconnect attachment 38.

Predetermined wheels 39 are preferred on the legs 7 of at least one end of the combined exerciser and therapist table 1.

The roller tracks 5 can include top surfaces of tubular beams 40 extended intermediate the head-leg frame 12 and the foot-leg frame 13. The rollers 4 can include edge-rimmed rollers 41 attached rotationally to the exerciser frame 6 and having a roller rim 42 overlapping at least one side of the tubular beams 40 as shown in FIGS. 1–4, and 11.

Optionally as shown in FIGS. 5–6, 9–10 and 12–16, the roller tracks 5 can include surfaces of angle beams extended intermediate the head-leg frame 12 and the foot-leg frame 13. The rollers 4 can include non-rimmed rollers 43 attached rotationally to the exerciser frame 6.

As shown in FIGS. 1–2, 5–6, 11 and 14, the exerciser frame 6 can include a support beam 44 positioned vertically below the roller tracks 5 and articulated for supporting the roller tracks 5.

A new and useful combined exerciser and therapist table having been described, all such foreseeable modifications, adaptations, substitutions of equivalents, mathematical possibilities of combinations of parts, pluralities of parts, applications and forms thereof as described by the following claims and not precluded by prior art are included in this invention.

What is claimed is:

1. A combined exercise and therapist table comprising: an exercise pad on a pad frame, said pad frame is supported by oppositely disposed rollers which are rotational on roller tracks, said roller tracks are supported by said exercise and therapist table on a plurality of legs; said pad frame being rectangular with a head end and a foot end; said exercise pad including a torso portion proximate said head end and a leg portion proximate said foot end of said pad frame and having a midsection there between; said exercise frame being rectangular with a head-leg frame proximate said head end and a foot-leg frame proximate said foot end of said exercise and therapist table, an upstanding vertically oriented foot end frame attached detachably to a top of said plurality of legs of said foot leg frame; said foot-end frame including a plurality of strap hooks and a U-Shaped leg strap detachably attachable and extending downwardly at desired vertically spaced-apart distances from said plurality of strap hooks and above said foot leg frame; said hooks are oppositely disposed for supporting said leg strap whereby a users legs are hooked over the leg strap; a horizontal pressure bar having oppositely disposed bar-end beams extending downwardly and pivotally attached to oppositely disposed sides of said foot-leg frame respectively whereby said pressure br is grasped by a user lying on said exercise pad and pivoted downward to a desired position above said midsection of said exercise pad for applying pressure in opposition to said leg strap while the users legs are hooked over said leg strap for transmission of the pressure to the users torso and upper legs; an upstanding vertically oriented, head-end frame attached detachably to a top of said plurality of legs of said head-leg frame; said head-end frame including a plurality of bar hooks and a hand bar; said bar hooks are oppositely disposed for supporting said hand bar horizontally at desired vertically spaced-apart distances above said head-end; said pressure bar being vertically pivotal from a hand grasp position to a non-interference position in which said bar-end beams are selectively parallel to said upstanding vertically oriented foot-end frame; said torso portion is pivotal between select angular sitting support positions at which said torso portion is lockable with a support bar extended selectively intermediate a bottom surface of said torso portion and where a bar lock is attached to said exercise frame; one or more resistance members comprising a two-way resistor having predetermined resilient pressure resistance articulated for resisting linear travel of said exercise and therapist table in either direction on said roller tracks between an said intermediate leg portion and said foot-end of said exercise and therapist table.

2. The combined exercise and therapist table of claim 1 wherein:

the lift-bar hooks include weight-lifting features for retaining the lift bar containing predetermined weights for weight-lifting exercise;

the weight-lifting features allowing vertical lifting of the lift bar up and out of the lift-bar hooks; and the weight-lifting features allowing downward lowering of the lift bar into the lift-bar hooks by a user lying on the exercise pad.

3. The combined exercise and therapist table of claim 1 wherein:

the lift-bar hooks include lateral-tension structure for withstanding tension from human-strength pushing and pulling laterally from the exercise pad.

4. The combined exercise and therapist table of claim 1 and further comprising:

at least one pressure gage positioned predeterminedly on the combined exerciser and therapist table for measuring linear pressure applied by the exerciser in opposition to the foot-leg frame.

5. The combined exercise and therapist table of claim 4 wherein:

predetermined positioning of the pressure gage includes positioning on the pressure bar for measuring pressure applied by the exerciser intermediate the pressure bar and the leg bar.

6. The combined exercise and therapist table of claim 4 wherein:

predetermined positioning of the pressure gage includes positioning on the leg bar for measuring pressure applied by the exerciser intermediate the head-end frame and the leg bar.

7. The combined exercise and therapist table of claim 1 wherein:

the legs include table-height adjusters for positioning the exercise pad at desired heights for exerciser use and optionally for therapist use to treat the user on the exercise pad.

8. The combined exercise and therapist table of claim 7 wherein:

the table-height adjusters include lift springs positioned in the legs and pressured against leg bottoms in each of the legs;

the lift springs being anchored to the legs; and the table-height adjusters having handled adjustment bolts for being inserted through leg apertures for fixing desired table heights by bolt-locked extension of the leg bottoms through leg-bottom apertures.

9. The combined exercise therapist table of claim 1 wherein:

attachment of the head-end frame and attachment of the foot-end frame to the legs includes predetermined quick-disconnect attachment.

10. The combined exercise and therapist table of claim 1 and further comprising:

"predetermined wheels on the legs of at least one end of the combined exerciser and therapist table" has been changed to—one or more wheels on said plurality of legs of at least one said end of said exercise and therapist table.

11. The combined exercise and therapist of table of claim 1 wherein:

the roller tracks include top surfaces of tubular beams extended intermediate the head-end frame and the foot-end frame; and the rollers include edge-rimmed rollers attached rotationally to the exerciser frame and having a roller rim overlapping at least one side of the tubular beams.

12. The combined exercise and therapist table of claim 1 wherein:

the roller tracks include surfaces of angle beams extended intermediate the head-leg frame and the foot-leg frame; and the rollers include non-rimmed rollers attached rotationally to the exerciser frame.

13. The combined exercise and therapist table of claim 1 wherein:

the exercise frame includes a support beam positioned vertically below the roller tracks and articulated for supporting the roller tracks.

* * * * *